US008985338B2

(12) United States Patent
Fux

(10) Patent No.: US 8,985,338 B2
(45) Date of Patent: Mar. 24, 2015

(54) STACKABLE PACKAGES FOR BEDDING PRODUCTS

(71) Applicant: Michael Fux, Fort Lauderdale, FL (US)

(72) Inventor: Michael Fux, Fort Lauderdale, FL (US)

( * ) Notice: Subject to any disclaimer, the term of this patent is extended or adjusted under 35 U.S.C. 154(b) by 0 days.

(21) Appl. No.: 14/165,144

(22) Filed: Jan. 27, 2014

(65) Prior Publication Data

US 2014/0208693 A1 Jul. 31, 2014

Related U.S. Application Data

(63) Continuation-in-part of application No. 13/483,135, filed on May 30, 2012, now Pat. No. 8,875,876, which is a continuation-in-part of application No. 13/047,682, filed on Mar. 14, 2011, now Pat. No. 8,875,875.

(60) Provisional application No. 61/757,129, filed on Jan. 26, 2013, provisional application No. 61/449,586, filed on Mar. 4, 2011.

(51) Int. Cl.

| | |
|---|---|
| ***B65D 85/00*** | (2006.01) |
| ***B65B 63/02*** | (2006.01) |
| ***B65D 30/08*** | (2006.01) |

(52) U.S. Cl.

CPC ..... *B65B 63/02* (2013.01); *B65D 31/02* (2013.01)

USPC ..... 206/756; 206/223; 206/494; 53/167

(58) Field of Classification Search

USPC ..... 206/756, 775, 477, 478, 223, 576, 770, 206/778, 440, 494, 524.8; 53/167, 441, 53/452, 455, 456

See application file for complete search history.

(56) References Cited

U.S. PATENT DOCUMENTS

| | | | | |
|---|---|---|---|---|
| 2,990,946 | A * | 7/1961 | Sheldon | 206/37 |
| 8,875,875 | B2 * | 11/2014 | Fux | 206/223 |
| 8,875,876 | B2 * | 11/2014 | Fux | 206/223 |
| 2003/0041564 | A1 * | 3/2003 | Schmidt | 53/412 |
| 2005/0222550 | A1 * | 10/2005 | Mitsui et al. | 604/385.201 |
| 2010/0142859 | A1 * | 6/2010 | Cushman | 383/10 |
| 2012/0060448 | A1 * | 3/2012 | Carmelo Calvano | 53/447 |

* cited by examiner

*Primary Examiner* — Jacob K Ackun
(74) *Attorney, Agent, or Firm* — Doherty IP Law Group LLC

(57) ABSTRACT

A package for bedding includes a blank of material formed into a loop, the loop having an enclosed top side, an enclosed bottom side, first and second enclosed lateral sides extending between the enclosed top side and the enclosed bottom side, a first openings at a first end of the loop, and a second opening at a second end of the loop. A section of the enclosed top side is joined together to form handle that extends along a top side of the loop between the first opening at the first end of the loop and the second opening at the second end of the loop. The package has a central opening defined by the enclosed top side, the enclosed bottom side, and the first and second enclosed lateral sides of the loop, the central opening extending from the first opening at the first end of the loop to the second opening at the second end of the loop. A box is disposed within the central opening of the loop.

12 Claims, 14 Drawing Sheets

FIG. 11
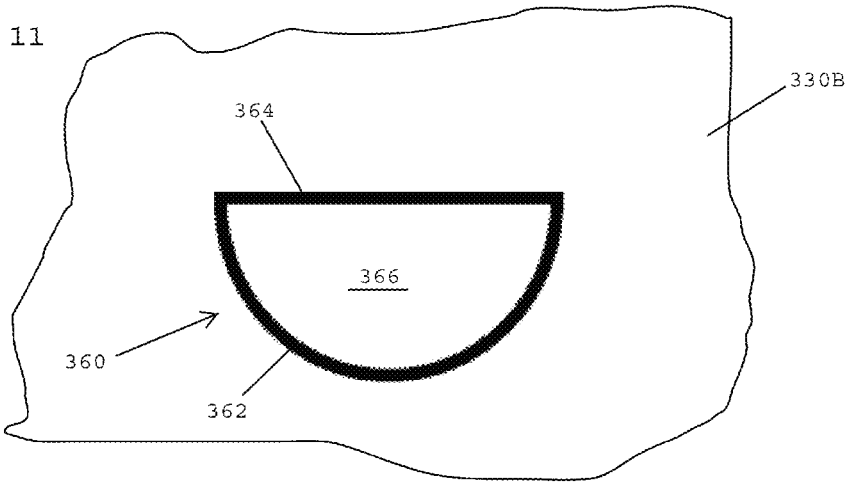
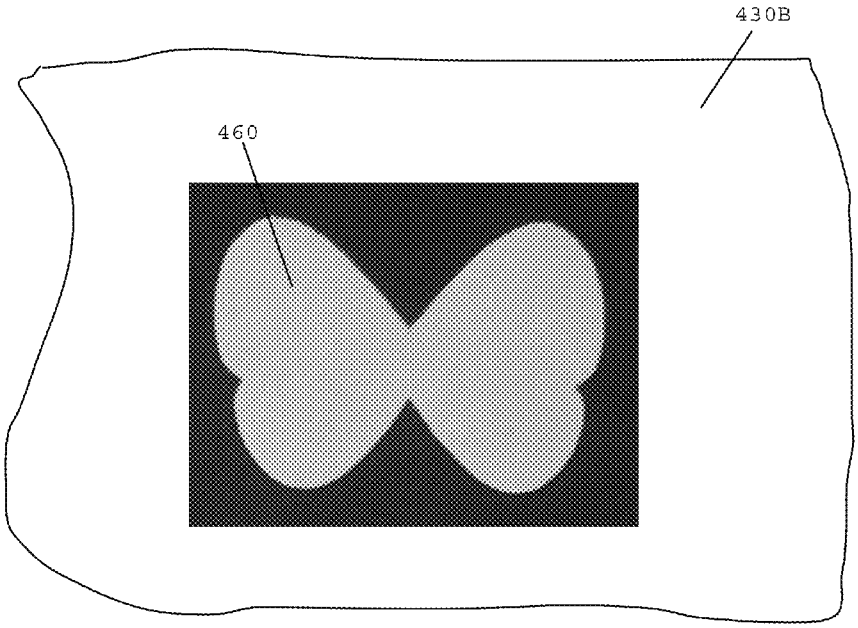
FIG. 12

STACKABLE PACKAGES FOR BEDDING PRODUCTS

CROSS-REFERENCE TO RELATED APPLICATIONS

The present application claims benefit of U.S. Provisional Application No. 61/757,129, filed Jan. 26, 2013 and is a continuation-in-part of commonly assigned U.S. patent application Ser. No. 13/483,135, entitled SEALABLE AND STACKABLE PACKAGES FOR BEDDING PRODUCTS, filed May 30, 2012, which is a continuation-in-part of commonly assigned U.S. patent application Ser. No. 13/047,682, entitled SEALABLE AND STACKABLE PACKAGES FOR BEDDING PRODUCTS, filed Mar. 14, 2011, which claims benefit of U.S. Provisional Application Ser. No. 61/449,586, filed Mar. 4, 2011, the disclosures of which are hereby incorporated by reference herein.

BACKGROUND OF THE INVENTION

1. Field of the Invention

The present application generally relates to packages and more specifically relates to packages for bedding products such as pillows, blankets, mattress toppers, and mattresses.

2. Description of the Related Art

Bedding products such as pillows, blankets, mattresses toppers, and mattresses are typically sold in corrugated boxes or flexible packages. For example, pillows may be sold in flexible packages with a package label placed inside the clear package and over the pillow.

There are a number of problems associated with conventional packages used to sell bedding products. One problem is that the label located inside the flexible package will wrinkle and crease, which makes it difficult for customers to read the label. A second problem is that flexible packages are not hermetically sealed and may be opened by customers who wish to sample the product, which may result in unsanitary and contaminated product. Another problem is that conventional packages for bedding products do not have a standard shape and configuration. Each package may have a slightly different shape so that a plurality of the packages may not be efficiently stacked in an array atop store displays.

The use of corrugated boxes for bedding also results in a number of drawbacks. First, corrugated boxes cannot be sealed for maintaining the soft bedding products in a "factory fresh" condition. Second, corrugated boxes are likely to get crushed during shipping and handling. In addition, it is difficult to print an aesthetically appealing and eye-catching label on an outer surface of a corrugated box.

SUMMARY OF THE INVENTION

In view of the above-noted problems, there remains a need for packages for bedding products that may be sealed (e.g. hermetically sealed), that maintain the goods in a "factory fresh" condition, that minimize the likelihood that the package will be crushed during shipping and handling, that may be readily stacked, that have an integrated handle, that may be folded flat when shipped and can be pulled up by consumers for easy portability, that have printed ink labels that lie below an outer protective layer to minimize fading and/or degradation of the ink, and that have labels that remain flat and will not wrinkle so that they may be easily read by customers. There also remains a need for stackable and sealable packages for bedding that have at least one vent opening formed in at least one of the panels for enabling air to circulate throughout the package after the package has been sealed. There also remains a need for packages for bedding products exhibiting various combinations of these features while not necessarily achieving others. For example, there remains a need for an easily packaged and transportable bedding package, even if it cannot be folded flat during shipment nor be sealed.

In one embodiment, a stackable package for bedding preferably includes a flexible outer container having an upper end and a lower end, a bottom panel extending along the lower end of the flexible container and side panels extending upwardly from the bottom panel toward the upper end of the flexible container for defining an open end of the flexible outer container. The flexible outer container may be made of a polymer material such as a low density polyethylene.

In one embodiment, the stackable package desirably has an insert disposed inside the flexible outer container for reinforcing the bottom and side panels of the flexible outer container, and bedding disposed inside the insert. In order to close the package, the upper ends of the side panels may be joined together for hermetically sealing the bedding inside the flexible outer container. The bedding may include soft bedding products that are compressible such as pillows, mattress toppers, mattresses and blankets.

In one embodiment, the insert desirably has a box-shaped lower end that engages the bottom and side panels of the flexible outer container. The box-shaped insert is preferably adapted to stretch the bottom panel and lower ends of the side panels of the flexible outer container when the insert is disposed inside the flexible outer container.

In one embodiment, the upper ends of the side panels are not reinforced and unsupported by the insert. In one embodiment, the upper ends of the side panels are joined together and the joined together upper ends define a flexible handle that is foldable into a horizontal configuration for stacking the package and into a vertical configuration for carrying the package. When the handle is in the horizontal configuration, the stackable package preferably has a box-like shape so one or more additional packages may be stacked atop the first package.

In one embodiment, the flexible outer container desirably includes a flexible laminate including a subsurface layer having an ink label printed thereon and a transparent outer layer that covers the ink printed label. The transparent outer layer preferably provides a glossy appearance for the package.

In one embodiment, the bedding, such as a pillow, mattress topper or mattress, is compressed before being inserted into the package and/or by the insert for minimizing the size and/or footprint of the bedding within the package.

The insert may be made of cellulose material. The insert is preferably more rigid than the flexible outer container. In one embodiment, the side panels of the flexible outer container are stretched taut by the insert that is disposed inside the flexible outer container.

In one embodiment, the handle of the stackable package is folded into a horizontal configuration to provide a flat, horizontal surface at the upper end of the outer container. A flat bottom surface of a second stackable package is positionable on the flat, horizontal surface of the first package. As a result, a plurality of the packages may be stacked atop and adjacent one another in an array. For example, in one embodiment, additional stackable packages are abutted against the respective side panels of the first package.

In one embodiment, a hermetically sealed package for bedding preferably includes a flexible outer container having a bottom panel and side panels extending upwardly from the bottom panel, a box-shaped insert disposed inside the flexible outer container, the box-like insert stretching and reinforcing the bottom and side panels of the flexible outer container, and bedding disposed inside the box-like insert. The insert preferably compresses the bedding for minimizing the size of the bedding disposed inside the package.

In one embodiment, the flexible outer container desirably includes a polymer laminate having a substrate layer with an ink label printed thereon and a transparent cover layer overlying the label printed on the substrate layer adapted to protect the ink label.

In one embodiment, the box-shaped insert is preferably adapted to stretch the bottom panel and lower ends of the side panels of the flexible outer container when the insert is disposed inside the flexible outer container. In one embodiment, the upper ends of the side panels are desirably unsupported by the insert.

The upper ends of the side panels of the flexible outer container are joined together to define a handle that is foldable into a horizontal configuration for stacking the package and into a vertical configuration for carrying the package. The package preferably has a box-like shape when the handle is in the horizontal configuration so that a second hermetically sealed package is stackable atop the first hermetically sealed package.

In one embodiment, a method of sealing bedding within a stackable package includes providing a flexible outer container having an upper end and a lower end, a bottom panel extending along the lower end of the flexible container and side panels extending upwardly from the bottom panel toward the upper end of the flexible container for defining an opening at the upper end of the flexible outer container. The method desirably includes disposing a box-shaped insert inside the flexible outer container for reinforcing the bottom and side panels of the flexible outer container, the box-shaped insert having an opening at an upper end thereof that is in alignment with the opening at the upper end of the flexible outer container. The method also preferably includes disposing bedding inside the box-shaped insert, and joining upper ends of the side panels of the flexible outer container for hermetically sealing the bedding inside the package.

In one embodiment, a sealable and stackable package for soft bedding products, such as mattresses, pillows, and mattress toppers, preferably includes a flexible outer container having a sealed lower end including a bottom panel and side panels that extend upwardly from the bottom panel to an opening at an upper end of the outer container. A label is preferably printed on the outer surface of the outer container and a transparent, glossy layer may be laminated over the printed label for protecting the printed label and providing the package with a glossy appearance. In one embodiment, the outer container is reverse printed, which is otherwise referred to as trap printed. In one embodiment, the ink is printed below the outer surface of the outer container so that the ink-printed label is not subjected to environmental conditions that may fade or otherwise degrade the ink.

In one embodiment, an insert such as a paperboard or corrugated insert is disposed inside the outer container for providing structural support to the outer container. The insert preferably has an outer dimension that matches the inner dimension of the outer container so that the insert slightly stretches the side panels of the outer container when positioned inside the outer container. In one embodiment, the insert is a corrugated insert that provides additional rigidity to the package so that it does not collapse upon itself. The internal reinforcement of the package provided by the corrugated insert allows for stacking of multiple packages atop one another on shelves and/or pallets. The insert desirably provides shape, support and structure to the bottom and intermediate regions of the flexible outer container, however, the upper ends of the side panels of the outer container are not reinforced by the insert so that they remain flexible.

In one embodiment, a soft bedding product is preferably inserted into the insert, which, in turn, is disposed in the outer container. The soft bedding product may be slightly compressed and/or folded prior to insertion into the insert and the insert will desirably hold the soft bedding product in a compressed and/or folded configuration.

After the outer container has been filled with the soft bedding product, the upper end of the outer container may be hermetically sealed for securing the soft bedding product in a sealed environment. The outer container may have an integrated handle that is preferably folded flat into a horizontal configuration for shipping but that may be pulled up into a vertical configuration by consumers for carrying the package.

In one embodiment, a method of making a stackable hermetically sealed package for bedding products preferably includes providing bedding having a first size, compressing the bedding into a second size that is smaller than the first size, disposing the compressed bedding inside the box-shaped insert, whereby the box-shape insert maintains the compressed bedding at the smaller second size, and joining the upper ends of the side panels of the flexible outer container for hermetically sealing the compressed bedding inside the package.

In one embodiment, the ink label is preferably reverse printed or trap printed on the flexible outer container. This means that the printed ink label is covered by a transparent protective coating or layer that protects the printed ink label from being subjected to environmental conditions that may fade or otherwise degrade the inks. In one embodiment, the trap printed nature of the label provides the outer container with ornamental benefits such as resilient representation of the inks, which are desirably shiny and metallic in appearance.

As noted above, the insert provides structure to the lower and intermediate regions of the outer container. The upper end of the outer container is flexible and is not reinforced by the insert. As such, after the package has been sealed, the upper end of the outer container preferably remains flexible so that it may be folded atop the bag to provide a flat surface suitable for stacking. The insert preferably provides rigidity to the package so that it does not collapse upon itself and so that it is stackable on shelves and/or pallets. In one embodiment, the sealed package has a handle that is folded down so that the package has a flat top, a flat bottom, and flat sides that provide the package with a box-like shape that is suitable for stacking.

In one embodiment, a stackable package for bedding includes a flexible outer container having an upper end and a lower end, a bottom panel extending along the lower end of the flexible container and side panels extending upwardly from the bottom panel toward the upper end of the flexible container for defining an open end of the flexible outer container, an insert disposed inside the flexible outer container for reinforcing the bottom and side panels of the flexible outer container, and bedding disposed inside the insert. In one embodiment, the side panels of the flexible outer container have upper ends that are joined together for sealing the bedding inside the flexible outer container. In one embodiment, at least one of the side panels has at least one vent opening formed therein. The at least one vent opening desirably has a geometric shape. In one embodiment, the at least one vent opening has a circular shape. The at least one vent opening may include a plurality of vent openings, whereby the vent openings may include a circular-shaped vent opening, a half-moon shaped vent opening, and a butterfly-shaped vent opening.

In one embodiment, a sealed package for soft bedding preferably includes a flexible outer container having a bottom panel and side panels extending upwardly from the bottom panel, a box-shaped insert disposed inside the flexible outer container, the box-like insert stretching and reinforcing the bottom and side panels of the flexible outer container, bedding disposed inside the box-like insert, whereby the insert compresses the bedding for minimizing the size of the bedding disposed inside the package, and at least one vent opening formed in at least one of the bottom panel and side panels for allowing air to circulate through the package after the package is sealed.

In one embodiment, a method of sealing bedding within a stackable package includes providing a flexible outer container having an upper end and a lower end, a bottom panel extending along the lower end of the flexible container and side panels extending upwardly from the bottom panel toward the upper end of the flexible container for defining an opening at the upper end of the flexible outer container, and forming at least one vent opening in at least one of the panels. The method includes disposing a box-shaped insert inside the flexible outer container for reinforcing the bottom and side panels of the flexible outer container, the box-shaped insert having an opening at an upper end thereof that is in alignment with the opening at the upper end of the flexible outer container, providing bedding having a first size, compressing the bedding into a second size that is smaller than the first size, disposing the compressed bedding inside the box-shaped insert, whereby the box-shape insert maintains the compressed bedding at the smaller second size, and joining upper ends of the side panels of the flexible outer container for sealing the compressed bedding inside the package, whereby the at least one vent opening allows for circulation of air throughout the sealed package.

In one embodiment, a blank having a top, bottom, first side, and second side, may be provided for forming a package. The blank may be configured into a loop by sealing the first and second sides. Areas adjacent to a mid-line formed between the top and bottom may then be joined to form a handle and an opening, thus completing the package. A box may be placed within the opening for storage and transport thereof. Various bedding products may be contained within the box.

In one embodiment, rather than forming the package and thereafter securing the box within its opening, the package may be formed around the box. In this manner, the blank may be encircled around the box and the first and second ends sealed. The handle may then be formed by stretching the blank material around the box and forming a joint between the handle and the box.

In one embodiment, a package for bedding preferably includes a blank of material formed into a loop, the loop having an enclosed top side, an enclosed bottom side, first and second enclosed lateral sides extending between the enclosed top side and the enclosed bottom side, a first opening at a first end of the loop, and a second opening at a second end of the loop. A section of the enclosed top side is desirably joined together to form handle that extends along a top side of the loop between the first opening at the first end of the loop and the second opening at the second end of the loop. The package preferably has a central opening defined by the enclosed top side, the enclosed bottom side, and the first and second enclosed lateral sides of the loop, the central opening extending from the first opening at the first end of the loop to the second opening at the second end of the loop. In one embodiment, a box is desirably disposed within the central opening of the loop. The box may contain bedding.

In one embodiment, the blank material is stretchable. In one embodiment, the box is sized slightly larger than the central opening of the loop to stretch the blank material. In one embodiment, the box has an outer perimeter that is slightly larger than an inner perimeter of the central opening so that the box stretches the blank material when the box is inserted into the central opening.

In one embodiment, the blank material may be made of low density polyethylene, PET, synthetics, natural and combinations thereof. In one embodiment, the blank material may be made of multiple layers of low density polyethylene or PET that are laminated together.

In one embodiment, a method of making a package for bedding desirably includes providing a blank of a material having four side edges including a first side edge, a second side edge, a top side edge, and a bottom side edge, whereby the blank of material has a mid-line located between the first and second side edges and that extends from the top side edge to the bottom side edge. The method desirably includes joining the first and second side edges together in a seal to form a loop having a first opening, a second opening, and a central opening extending from the first opening to the second opening, joining together portions of the blank material adjacent to the mid-line to form a handle that extends along an upper end of the loop sections of the loop and between the first and second openings of the loop, and inserting a box into the central opening of the loop.

These and other preferred embodiments of the present invention will be described in more detail below.

BRIEF DESCRIPTION OF THE DRAWINGS

FIG. 11 shows a panel for a flexible outer container of a package having a half-moon shaped vent opening formed in the panel, in accordance with one embodiment of the present invention.

FIG. 12 shows a flexible outer container of a package with a panel having a butterfly-shaped vent opening formed in the panel, in accordance with one embodiment of the present invention.

DETAILED DESCRIPTION

Figure 1:
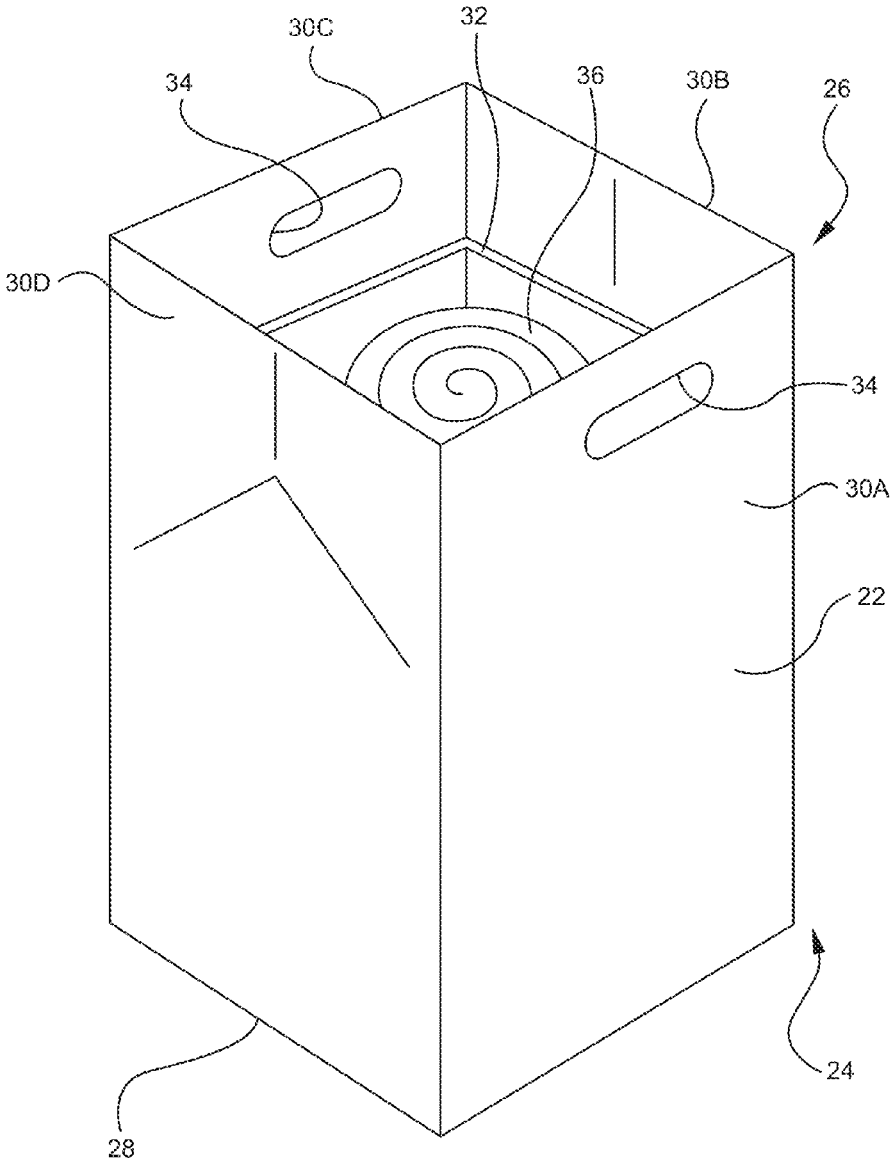
FIG. 1 shows a perspective view of a partially assembled package for bedding products including a flexible outer container, an insert, and a bedding product, in accordance with one embodiment of the present invention.

Referring to FIG. 1, in one embodiment, a package 20 for bedding products, such as mattress toppers, mattresses, pillows and blankets, preferably includes a flexible outer container 22 having a lower end 24 that is closed and an upper end 26 with a sealable opening. The outer container 22 preferably has a bottom panel 28 that extends in a horizontal direction along the lower end 24 of the bag and four side panels 30A-30D that extend from the bottom panel 28 to the upper end 26 of the bag. The outer container 22 is desirably made of one or more layers of flexible material that are laminated together. In one embodiment, the outer container 22 is made of multiple layers of low density polyethylene and/or PET that are laminated together. One or more package labels are preferably printed on the outer surfaces of the side panels 30A-30D. The printed label may comprise ink.

In one embodiment, the package 20 preferably includes an insert 32 that is disposed inside the outer container 22 for providing shape and structural support for the bottom panel 28, and the side panels 30A-30D of the outer container 22. The insert 32 is desirably made of a sturdy material such as corrugated paperboard that is more rigid than the outer container. The insert 32 preferably has a square, rectangular, or box-like shape that conforms to the shape of the bottom panel 28 and the side panels 30A-30D of the flexible outer container 22. As will be described in more detail below, the insert 32 preferably has an outer perimeter that matches or slightly exceeds the dimension and shape of the inner perimeter of the outer container. In one embodiment, the insert 32 slightly stretches the side panels 30A-30D of the outer container 22 to provide a snug fit between the insert and the outer container, whereupon the label on the outer container is stretched taut so that it may be easily read. The insert 32 preferably holds the shape of the outer container 22 in a rectangular or square configuration. The stretching of the outer container 22 by the paperboard insert 40 also ensures that the label printed on the outer container does not fold or wrinkle. Thus, the side panels of the flexible outer container 22 may be stretched, which makes the label easier to read and provides an outer container having enhanced aesthetics.

In one embodiment, the second and fourth side panels 30B, 30D of the outer container 22 preferably include creases adjacent the upper end 26 of the outer container 22 that enable the upper ends 26 of the outer container 22 to be collapsed together for sealing the upper ends of the side panels 30A-30D together. The upper ends of the first and third side panels 30A, 30C of the outer container 22 desirably have opposing openings 34, such as elongated openings, that may be aligned when the first and third side panels are sealed together for forming a handle for the package.

After the paperboard insert 32 has been positioned inside the outer container 22, the package 20 is adapted to receive a bedding product 36 such as a pillow or mattress topper. The bedding product 36 may be compressed prior to and/or during insertion into the package 20. The bedding product 36 is desirably held within the insert 32, which, in turn, is disposed inside the flexible outer container 22. The bedding product insertable into the package may be selected from a broad range of bedding products including pillows, mattress toppers, and blankets. In one embodiment, the bedding product 36 is slightly compressed and held in a compressed configuration by the insert 32 of the package 20.

In one embodiment, the insert has an outer perimeter of 18 inches in width by 18 inches in length. The inner perimeter of the outer container is also 18 inches by 18 inches. The insert stretches the flexible outer container to maintain the panels of the outer container taut.

Figure 2:
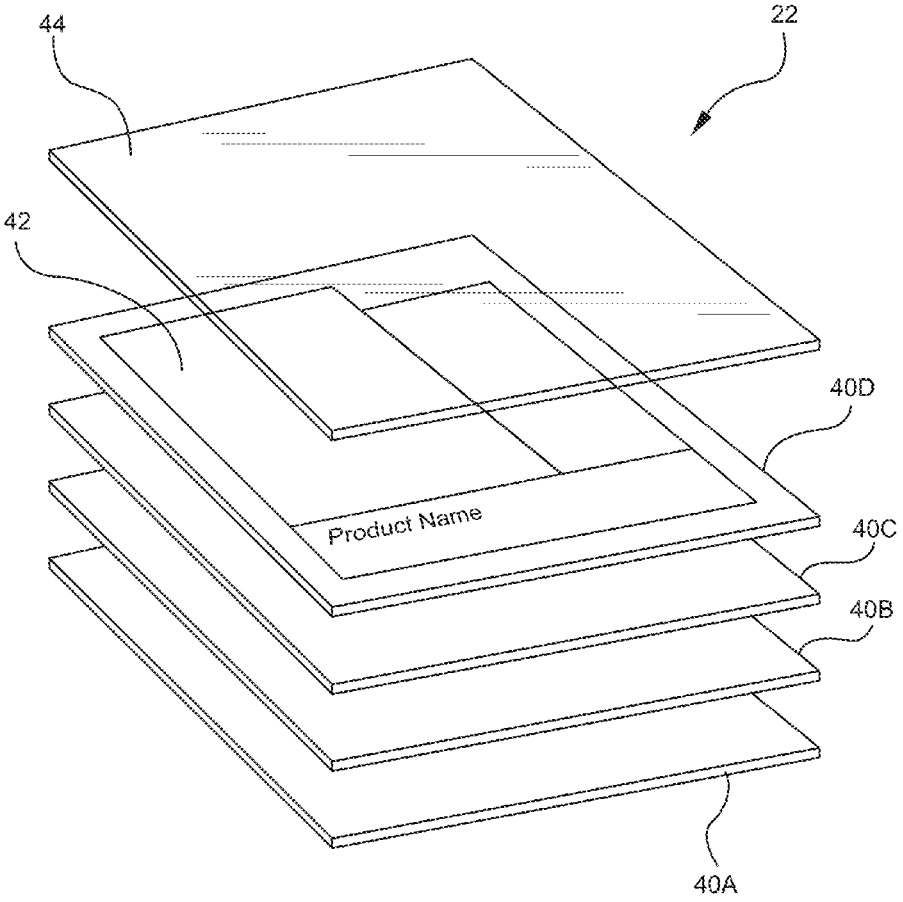
FIG. 2 shows the layers used to make the flexible outer container of FIG. 1, in accordance with one embodiment of the present invention.

Referring to FIG. 2, in one embodiment, the outer container 22 is desirably made by laminating two or more flexible layers together. In one embodiment, four layers of a low density polyethylene material 40A-40D are laminated together. In other embodiments, fewer or more layers may be laminated together. An ink label 42 is preferably printed on the top layer 40D to form a sub-surface label for the outer container 22. A transparent, high-gloss top surface layer 44 is preferably laminated atop the sub-surface label 42 printed on the top layer 40D. The high gloss top surface layer 54 seals the sub-surface printing so that the ink cannot be rubbed off the outer container 22, and desirably provides the outer container with a shiny or glossy appearance.

Figure 3A:
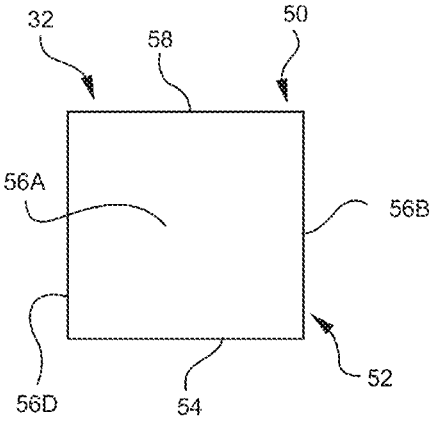
FIGS. 3A and 3B show respective front elevation and top plan views of the insert of FIG. 1, in accordance with one embodiment of the present invention.
Figure 3B:
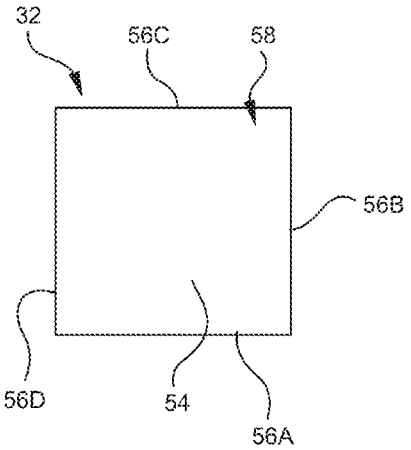

Referring to FIGS. 3A and 3B, in one embodiment, the paperboard insert 32 preferably includes an upper end 50, a lower end 52, a flat bottom panel 54 that extends along the lower end 52, and side panels 56A-56D that extend between the upper end 50 and the lower end 52. The insert 32 is preferably closed at the lower end 52 and has an opening 58 at the upper end 50 that is adapted for receiving a bedding product. The insert 32 preferably has a square or rectangular shape.

Figure 4A:
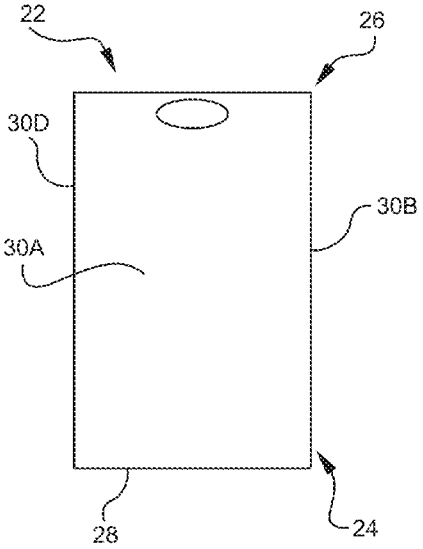
FIGS. 4A and 4B show respective front elevation and top plan views of the flexible outer container of FIG. 1.
Figure 4B:
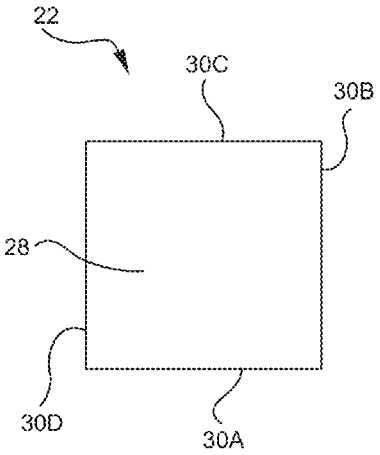

Referring to FIGS. 4A and 4B, in one embodiment, the outer container 22 preferably includes the lower end 24, the upper end 26, the bottom panel 28 that extends along the lower end 24, and side panels 30A-30D that extend from the bottom panel 28 to the upper end 26 of the outer container 22. The outer container 22 is desirably closed at the lower end 24 and is initially open at the upper end 26 for receiving the insert 32 and the soft bedding product.

Figure 5:
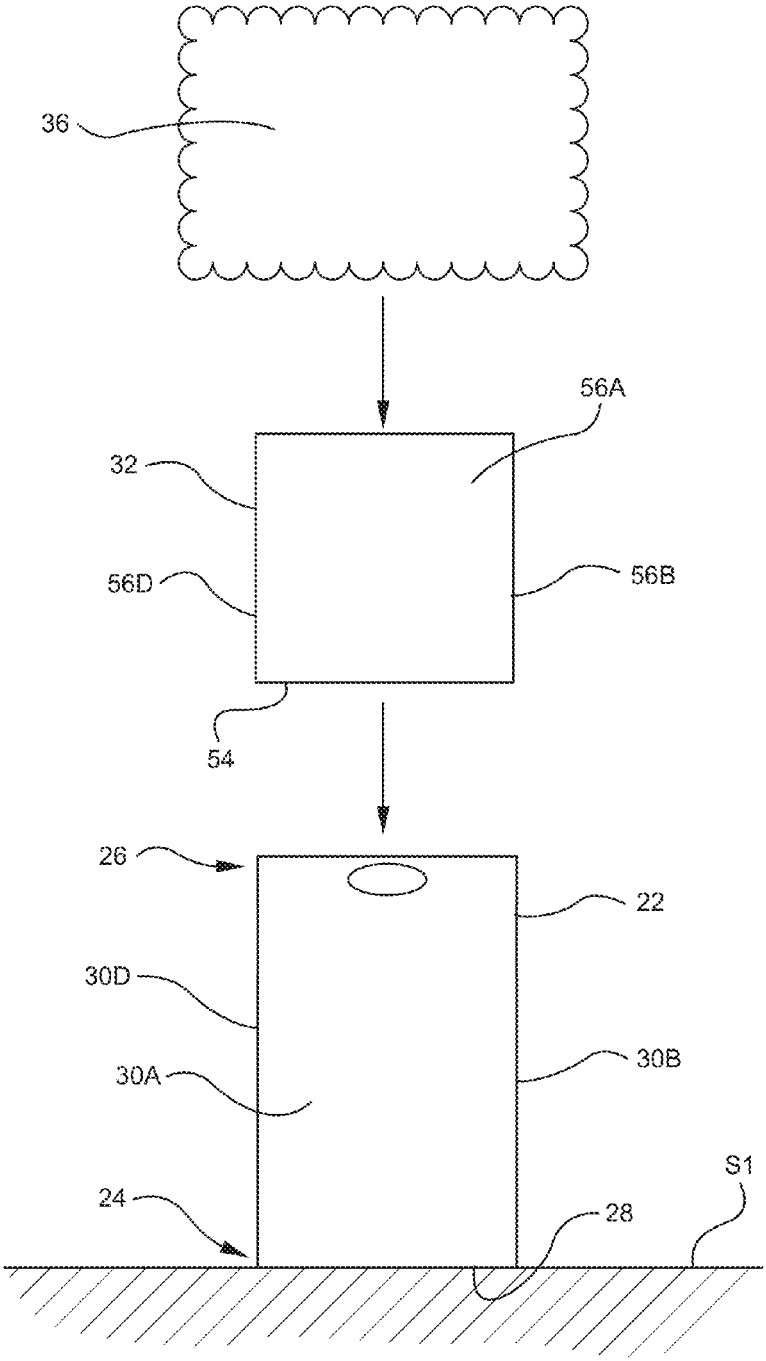
FIG. 5 shows the bedding product, insert and flexible outer container of FIG. 1 prior to assembly of the package and insertion of the bedding material into the insert and the flexible outer container, in accordance with one embodiment of the present invention.

Referring to FIG. 5, in one embodiment, the bottom panel 28 of the outer container 22 is positioned atop a surface S1. The side panels 30A-30D are pressed away from one another for maximizing the size of the opening at the upper end 26 of the outer container 22. The insert 32 is preferably inserted through the opening at the upper end of the outer container 22. The insert 32 is preferably advanced toward the bottom panel 28 of the outer container 22 until the bottom panel 54 of the insert abuts against the bottom panel 28 of the outer container 22. As the insert 32 moves toward the lower end 24 of the outer container 22, the side panels 56A-56D of the insert 32 preferably stretch the side panels 30A-30D of the outer container 22. As noted above, one of the benefits of stretching the side panels of the outer container is that the label printed on the side panels is slightly stretched, which prevents wrinkling of the label and makes it easier for customers to read the label.

In one embodiment, the soft bedding product 36 may be folded and/or slightly compressed prior to insertion into the insert 32, which, in turn, is disposed inside the outer container 22. In one embodiment, the insert 32 is desirably sufficiently sturdy for maintaining the soft bedding product in the compressed state, which minimizes the footprint of the product.

Figure 6A:
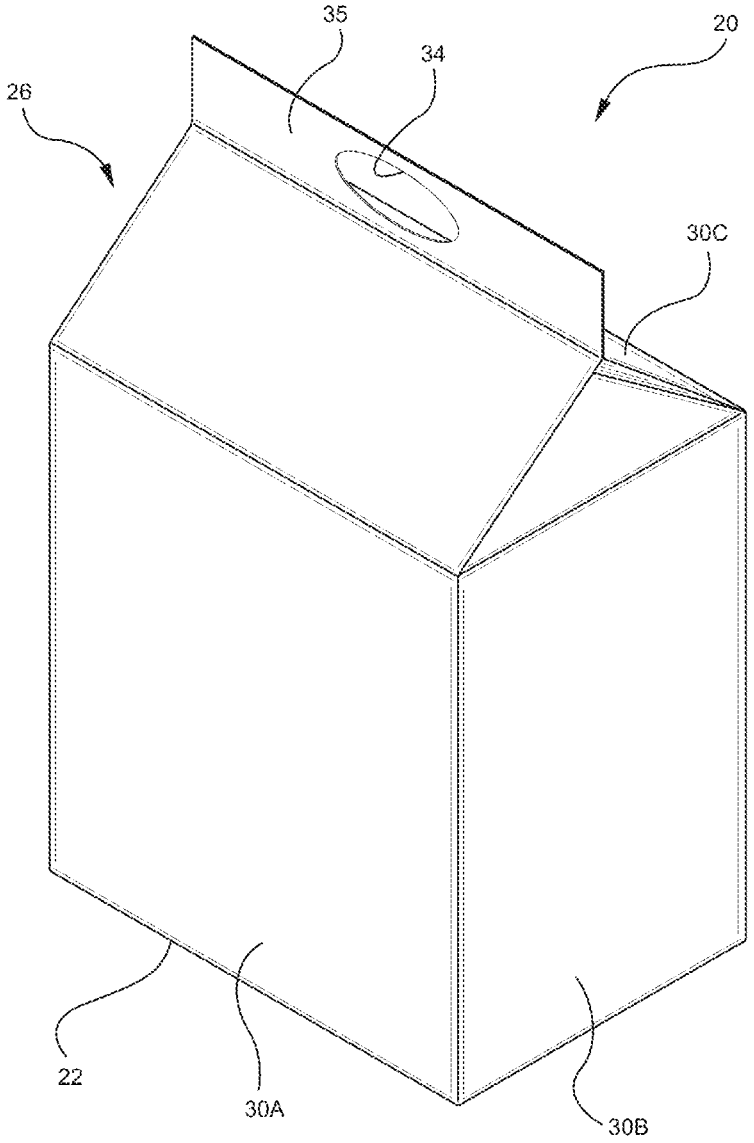
FIGS. 6A-6C show perspective, front elevation, and side elevation views of the package shown in FIG. 1 after joining upper ends of the side panels of the flexible outer container, in accordance with one embodiment of the present invention.
Figure 6B:
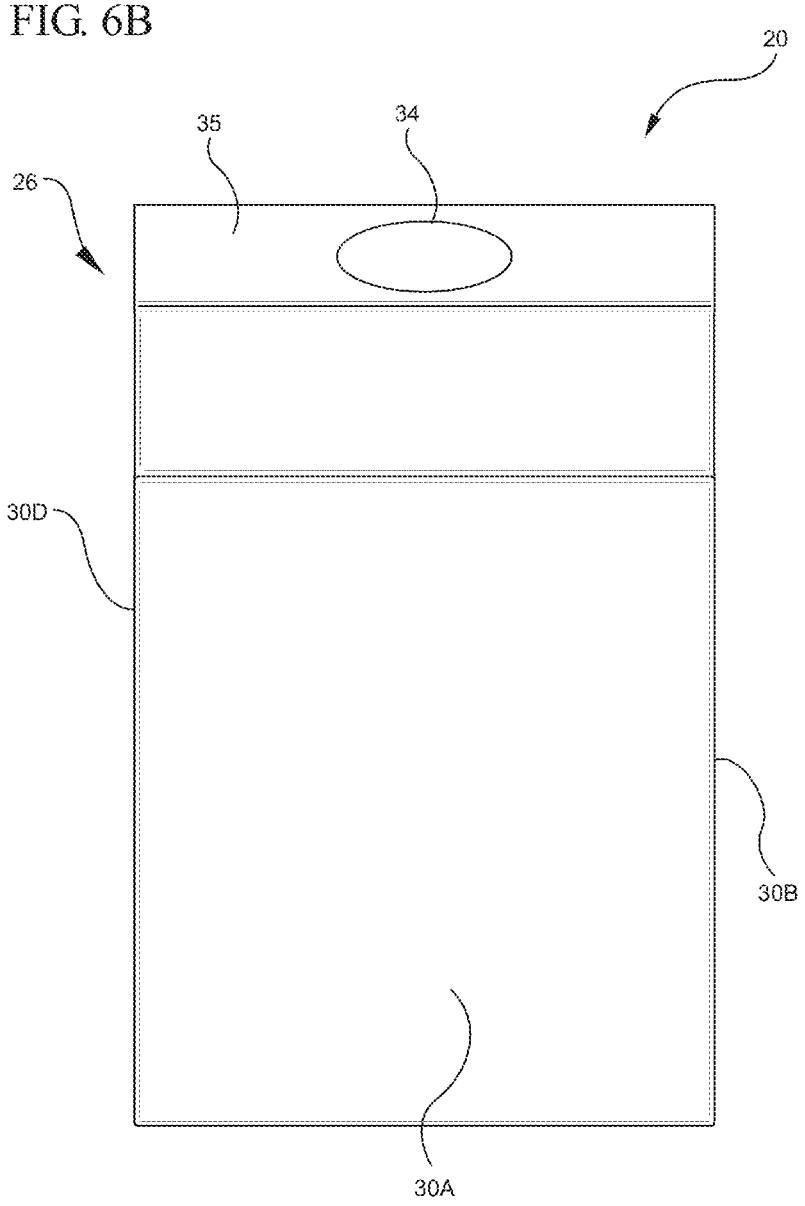
Figure 6C:
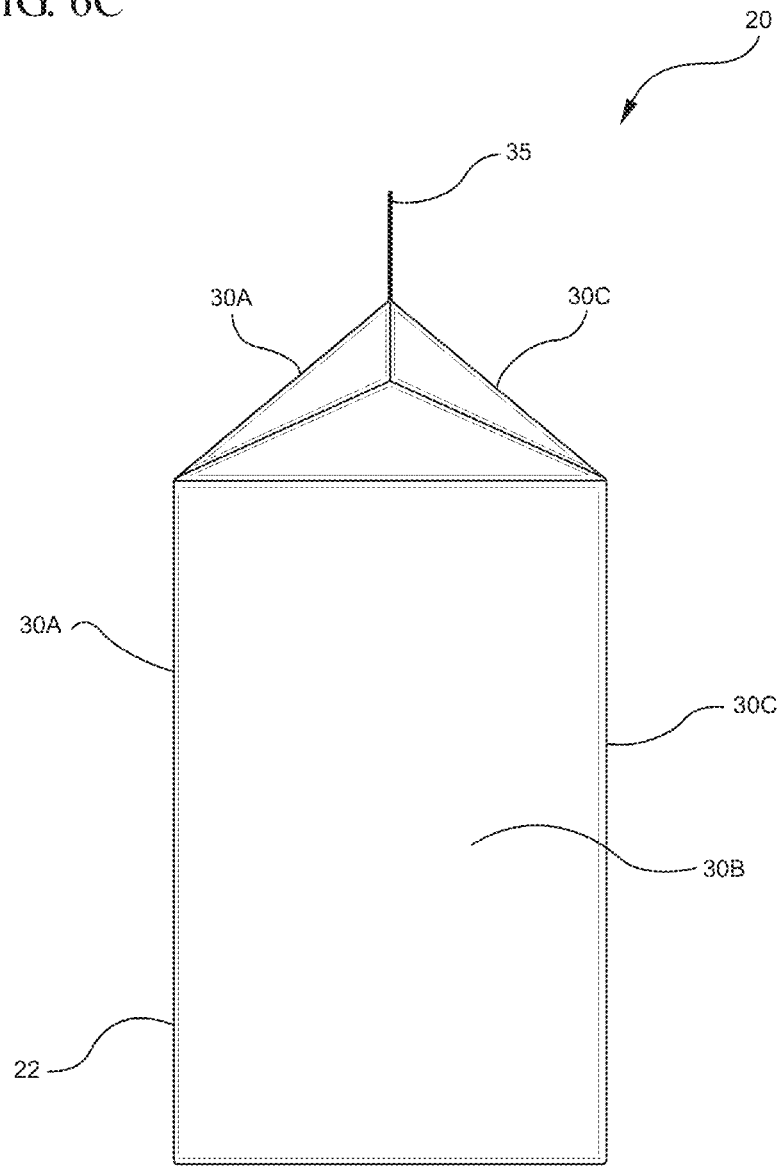

Referring to FIGS. 6A-6C, in one embodiment, after the paperboard insert and the soft bedding material have been disposed inside the flexible outer container 22, the upper end 26 of the outer container is sealed. In one embodiment, this is accomplished by collapsing the upper ends of the side panels 30A-30D toward one another. In one embodiment, a hermetic seal may be formed for joining the upper ends of the side panels 30A-30D by using two metal plates that are heated and pressed together to form a hermetic seal. In one embodiment, the elongated openings 34 provided in the first and third side panels 30A, 30C are aligned with one another to define a handle 35 at the upper end 26 of the package 20. The hermetically sealed package preferably maintains the soft bedding product within a sealed environment that protects the soft bedding product from contamination including dirt, allergens, and dust mites. Although the present invention is not limited by any particular theory of operation, it has been observed that some customers do not like the idea that bedding products may be touched and contaminated by other consumers. The sealed packages disclosed herein provide a level of assurance that the soft bedding products within the packages are "factory fresh", have not been handled, and are free of contamination.

Figure 7A:
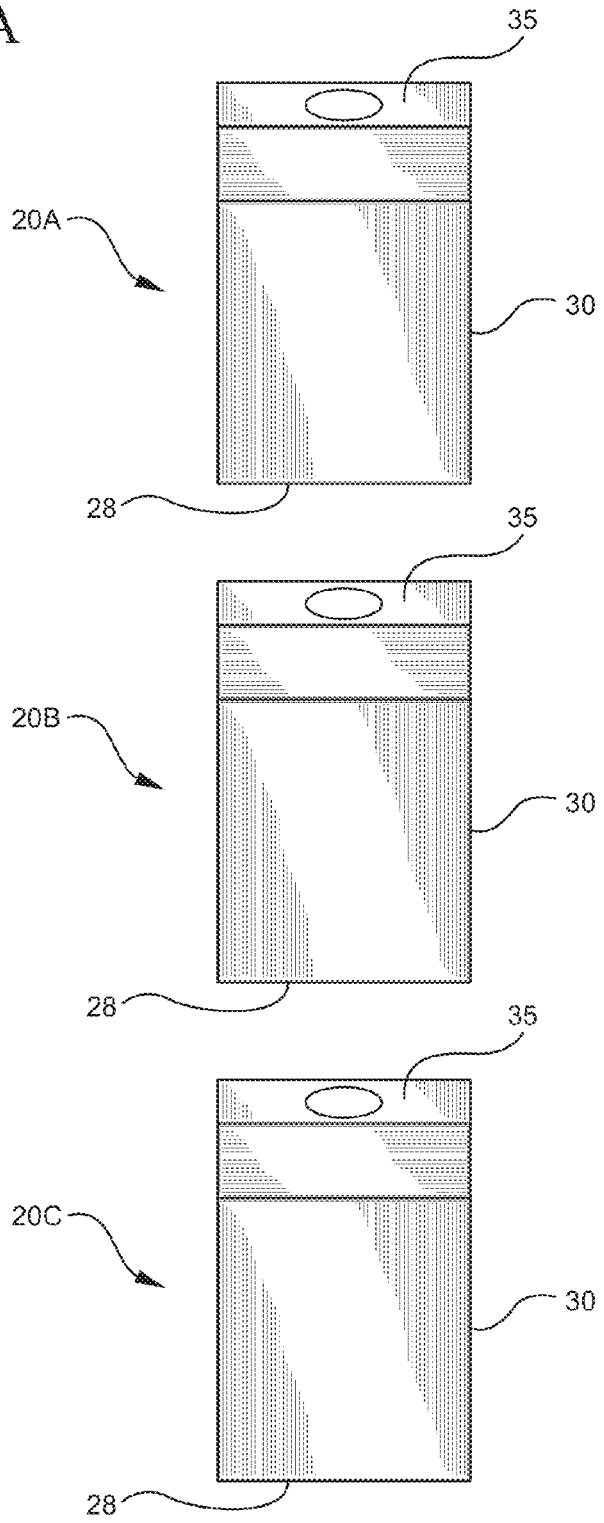
FIGS. 7A-7C show a method of stacking sealed packages for bedding products, in accordance with one embodiment of the present invention.
Figure 7B:
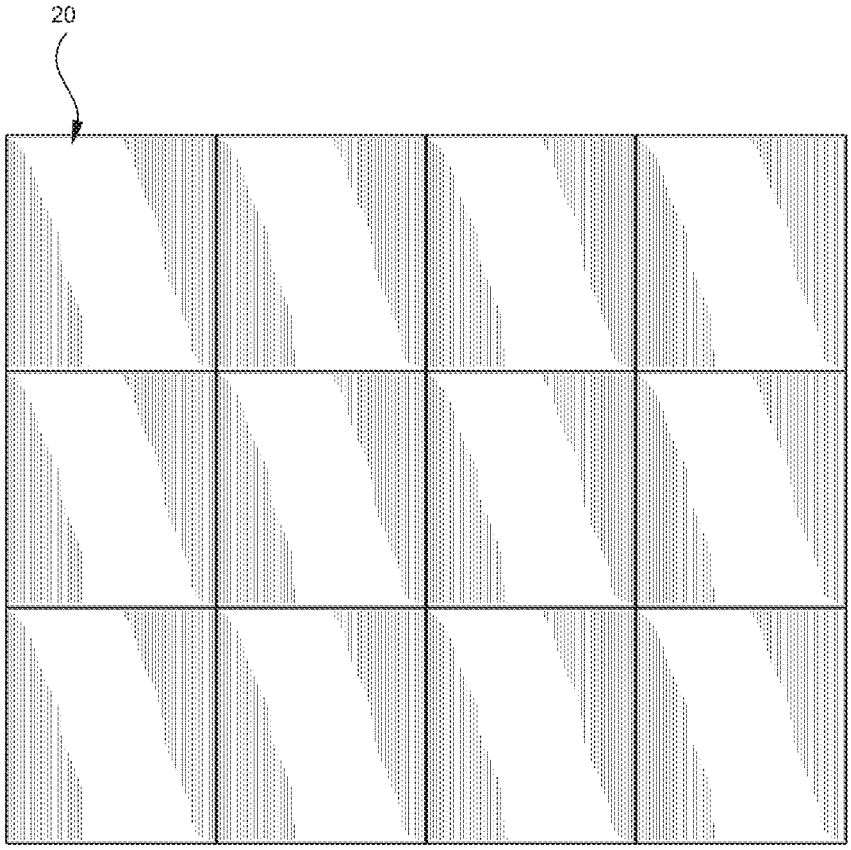
Figure 7C:
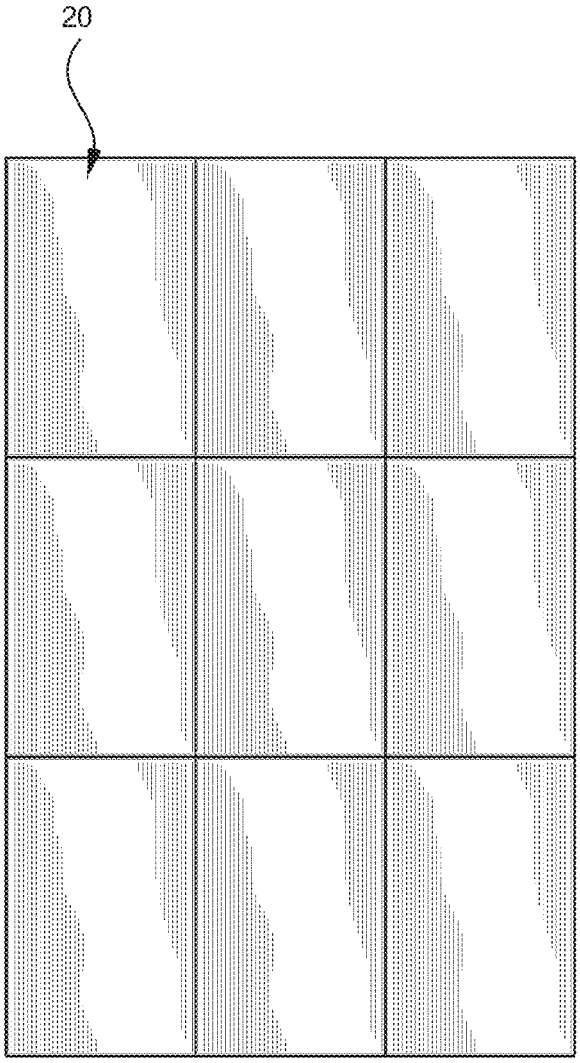

Referring to FIG. 7A-7C, in one embodiment, the flexible handles 35 formed at the upper ends of the side panels may be folded over into a horizontal configuration so that the sealed packages 20A-20C have flat top and bottom surfaces for being stackable atop one another. As shown in FIG. 7A, each of the sealed packages 20A-20C has a flat bottom surface 28 and flat side panels 30. Because the handle 35 and the upper end of each side panel is made of the flexible laminated material used to form the flexible outer container, the upper end of the outer containers may be folded for stacking so that the top surface of each sealed package is substantially flat.

FIG. 7B shows a front view of a plurality of the packages 20 with the handle folded flat and the packages stacked in a 4×3 array. The handle portion at the upper end of each of the flexible outer containers has been folded so that each sealed package has a substantially square, rectangular, or box-like shape. The side panels of the packages enable the packages to be stacked closely together in a side-by-side configuration. FIG. 7C shows a side view of the stacked packages shown in FIG. 7B.

Figure 8:
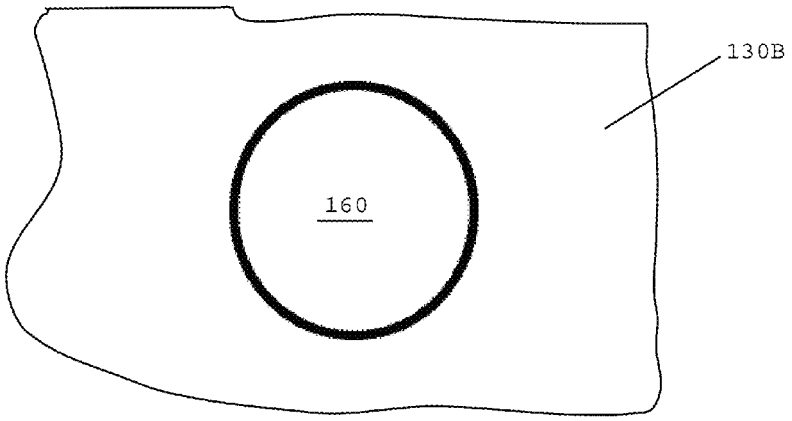
FIG. 8 shows a panel for a flexible outer container of a package having a circular-shaped vent opening formed in the panel, in accordance with one embodiment of the present invention.

Referring to FIG. 8, in one embodiment, a panel 130B of a package having a flexible outer container includes a circle-shaped vent opening 160 for enabling air to pass therethrough. As a result, air may pass back and forth from outside the sealed package to inside the sealed package. In one embodiment, if the package is compressed, air present inside the sealed package may escape through the circular-shaped vent opening 160. In one embodiment, the package includes one circular-shaped vent opening formed in one of the panels 130B. In other embodiments, however, two or more circular-shaped vent opening may be formed in one or more of the panels of a flexible outer container. For example, a first circular opening may be formed in a first panel and a second circular opening may be formed in a second panel.

Figure 9:
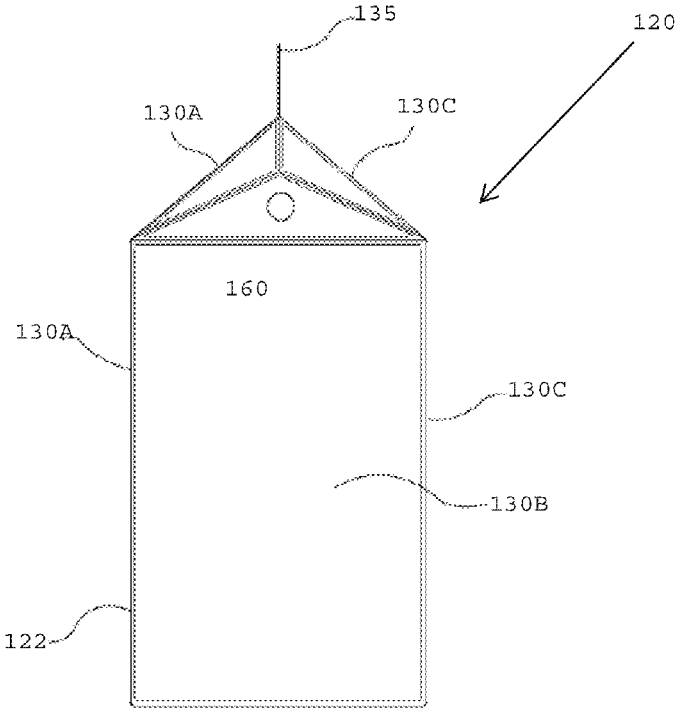
FIG. 9 shows a side elevation view of a package including the panel with the circular-shaped vent opening of FIG. 8.

Referring to FIG. 9, in one embodiment, a package for soft bedding products includes a flexible outer container 122 having side panels 130A-130C. The upper ends of the side panels are collapsed inwardly toward one another and sealed to define a handle 135 at the upper end of the package 120. In one embodiment, the package 120 remains sealed until purchased and opened by a consumer so that the bedding products stored therein may not be touched and/or contaminated by other consumers. The upper end of the second side panel 130B has a circular-shaped vent opening 160 formed therein that enables air to pass from inside the sealed package to outside the sealed package. Although FIG. 9 shows only one vent opening 160, other packages may have two or more vent opening formed in one or more of the side panels 130A-130C.

Figure 10:
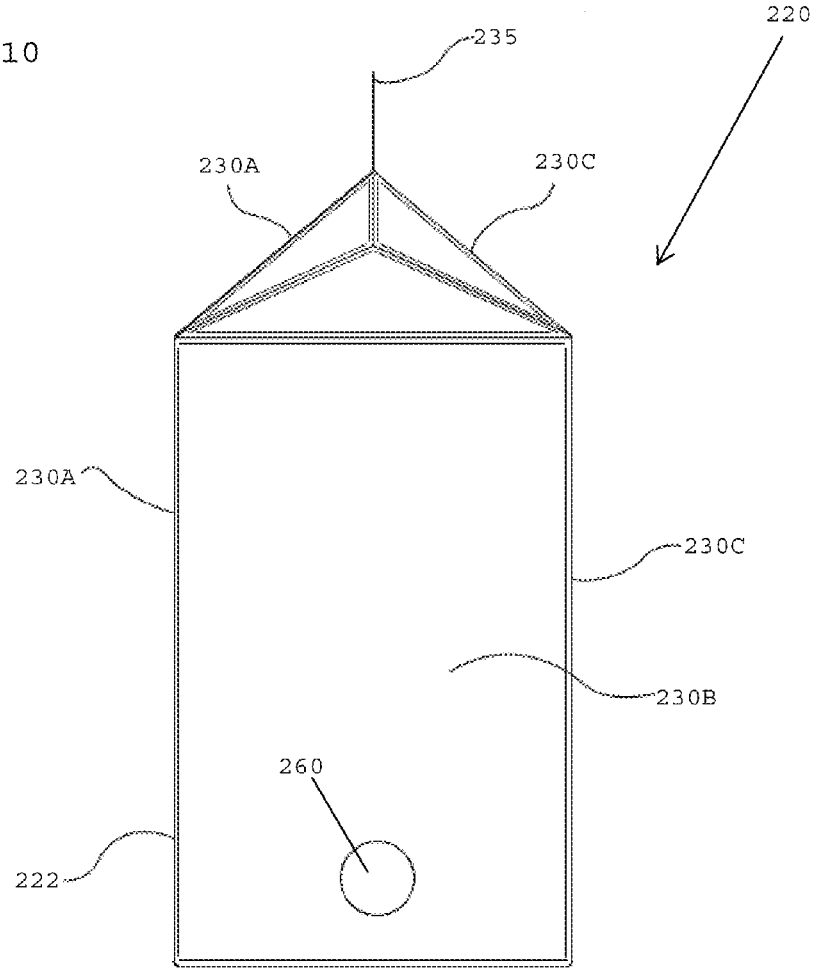
FIG. 10 shows a side elevation view of a package including a flexible outer container with a panel having a circular-shaped vent opening, in accordance with one embodiment of the present invention.

Referring to FIG. 10, in one embodiment, a package 220 including a flexible outer container 222 has side panels 230A-230C. A fourth side panel is not shown in FIG. 10. The upper ends of the side panels are sealed together to form a handle 235 that may be collapsed atop the upper end of the package 220. In one embodiment, the side panel 230B includes a circular-shaped vent opening 260 formed in the lower end thereof. The circular-shaped vent opening 260 enables air to pass from inside to outside the sealed package 220. In one embodiment, the sealed package 220 may include two or more circular-shaped vent openings 260 formed in one or more of the side panels.

Referring to FIG. 11, in one embodiment, a package includes a flexible outer container having a side panel 330B with a half-moon shaped vent opening 360 formed therein. The half-moon shaped vent opening includes a cut line 362, a fold line 364 and a flexible flap 366. The half-moon shaped vent opening 360 defines an opening that enables air to circulate throughout the package by passing back and forth from the inside to the outside a sealed flexible outer container. In one embodiment, a flexible outer container for a package may include two or more half-moon shaped vent opening 360 formed in one or more of the side panels of the flexible outer container.

Referring to FIG. 12, in one embodiment, a package includes a flexible outer container having a side panel 430B with a butterfly-shaped vent opening 460 formed therein. The vent opening 460 enables air to pass back and forth from the inside to the outside of the sealed package. In one embodiment, the flexible outer container of a sealed package includes two or more butterfly-shaped vent openings formed in one or more of the side panels.

Figure 13:
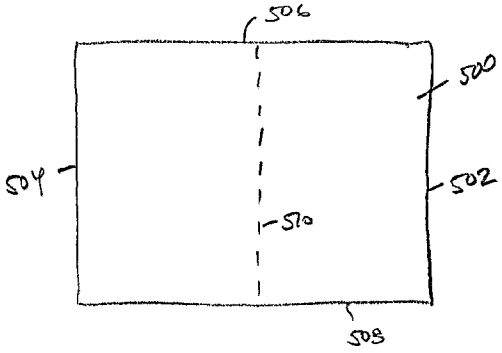
FIG. 13 shows a plan view of a blank for forming a package in accordance with one embodiment of the present invention.

FIGS. 13-17 depict further related embodiments of the present invention. In FIG. 13, a blank 500 is shown in plan view. The blank 500 is a generally planar construction and is typically configured from multiple layers of low density polyethylene and/or PET that are laminated together. Other materials, synthetic, natural, or a mixture, may also be utilized. The blank 500 includes a first side 502, opposed second side 504, and a top 506 and bottom 508 extending therebetween. Shown for later reference is an approximate mid-line 510 of the blank 500, extending between the top 506 and bottom 508.

Figure 14:
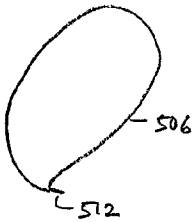
FIG. 14 shows a side view of the blank of FIG. 13 formed into a loop in a first configuration for forming a package in accordance with one embodiment of the present invention.

As shown in FIG. 14, a side view of the blank 500 configured into a loop, the first side 502 and second side 504 may be joined into a seal 512. Preferably, the seal 512 is formed by heat to mechanically bond the first side 502 and second side 504. Alternatively, various chemical adhesives or other bonding methods may be used.

Once the blank 500 is formed into the loop of FIG. 14, a handle portion 514 may be formed by joining portions of the blank 500 just adjacent to the mid-line 510 in a joint 515. The joining of these portions may be achieved by the same means as the formation of the seal 512.

Figure 17:
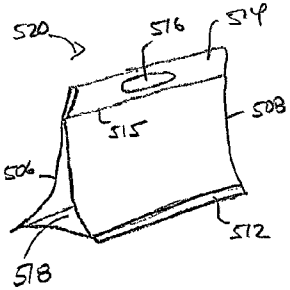
FIG. 17 shows a perspective view of the blank in the configuration shown in FIG. 15.

As shown in FIG. 17, in one embodiment the handle portion 514 may include an aperture 516.

Figure 16:
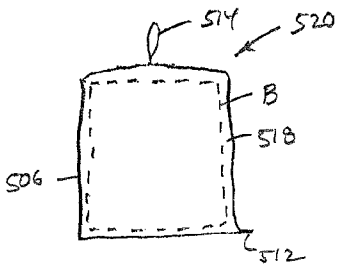
FIG. 16 shows a side view of the blank of FIG. 13 formed into its final configuration for forming a package together with an insert, in accordance with one embodiment of the present invention.
Figure 15:
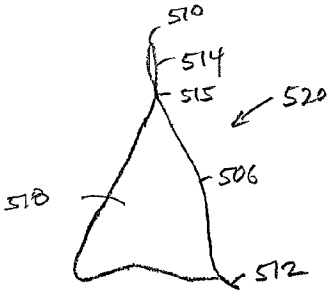
FIG. 15 shows a side view of the blank of FIG. 13 formed into its final configuration for forming a package in accordance with one embodiment of the present invention.

The observer will have noticed in FIGS. 15 and 17 that the blank 500, formed as shown, creates an opening 518 to form a completed package 520. It will be appreciated that the package 520 includes four enclosed sides with two additional sides left open. As shown in FIG. 16, a box (B) may be inserted into the opening 518 whereby a user may carry the box within the package 520 by virtue of the handle 514. Preferably the box (B) is sized slightly larger than the opening 518 to stretch the blank 500 material such that text placed on the blank can be easily read. This also helps to ensure that the box (B) will remain in the package 520 through shipping and transport.

In an alternative method, it will be appreciated that the box (B) may be placed on the blank 500 prior to the first side 502 and second side 504 being joined into the seal 512. In this manner, the package 520 is formed over the box (B) to partially enclose the box. Subsequently, the handle 514 may be formed by joining portions of the blank 500 just adjacent to the mid-line 510 in a joint 515. This joining may serve to stretch the blank 500 over the box (B) to secure the box within the now formed opening 518.

Although the present invention is not limited by any particular theory of operation, it is believed that providing one or more vent openings in one or more side panels of a flexible outer container enables air to circulate throughout the inside of a sealed package, and air to pass back and forth between the inside and the outside of a sealed package. In other embodiments, vent openings having other geometric shapes, sizes and dimensions may be used and still fall within the scope of the present invention.

The present invention provides a number of advantages over other packages used for bedding products by providing an insert for a flexible outer container that provides internal support for the package. As a result, any label that is printed on the outer container is held taut and/or slightly stretched so as to improve the readability of the label and avoid the wrinkling and creasing problems found in prior art packages.

In addition, the present application discloses a package for bedding products that is hermetically sealable. This enables the bedding product to be held inside the package in a slightly compressed condition for minimizing the overall size and dimension of the package. Moreover, the hermetically sealed package prevents contaminants such as dirt and dust mites from infiltrating the bedding product when stored inside the package. This is a desirable feature for customers who seek to purchase clean, "factory fresh" bedding products for personal use.

The package disclosed in the present application also has improved stackability over prior art packages used for bedding products. Because prior art packages for bedding products have no internal support structure, the packages have a shape that generally conforms to the shape of the bedding product contained therein. Moreover, no two conventional packages have the same shape and configuration. These factors make it difficult to uniformly stack prior art packages for bedding products, which requires more shelf space in retail outlets. By providing a package having a square, rectangular or box shape, efficiencies associated with stacking boxes may be obtained. Aesthetics and sight-lines are also desirably enhanced.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A package for bedding comprising:

a blank of material formed into a loop, said loop having an enclosed top side, an enclosed bottom side, first and second enclosed lateral sides extending between said enclosed top side and said enclosed bottom side, a first openings at a first end of said loop, and a second opening at a second end of said loop;

a section of said enclosed top side being joined together to form handle that extends along a top side of said loop between said first opening at said first end of said loop and said second opening at said second end of said loop;

said package having a central opening defined by said enclosed top side, said enclosed bottom side, and said first and second enclosed lateral sides of said of loop, said central opening extending from said first opening at said first end of said loop to said second opening at said second end of said loop;

a box disposed within said central opening of said loop.

2. The package as claimed in claim 1, wherein said blank material is stretchable.

3. The package as claimed in claim 2, wherein said box is sized slightly larger than said central opening to stretch said blank material.

4. The package as claimed in claim 2, wherein said box has an outer perimeter that is slightly larger than an inner perimeter of said central opening so that said box stretches said blank material when said box is inserted into said central opening.

5. The package as claimed in claim 1, wherein said blank material is selected from the group of materials consisting of low density polyethylene, PET, synthetics, natural and combinations thereof.

6. The package as claimed in claim 1, wherein said blank material comprises multiple layers of low density polyethylene or PET that are laminated together.

7. A method of making a package for bedding comprising:

providing a blank of a material having four side edges including a first side edge, a second side edge, a top side edge, and a bottom side edge;

said blank of material having a mid-line located between said first and second side edges and extending from said top side edge to said bottom side edge;

joining said first and second side edges together in a seal to form a loop having a first opening, a second opening, and a central opening extending from said first opening to said second opening;

joining together portions of said blank material adjacent to said mid-line to form a handle that extends along an upper end of said loop sections of said loop and between said first and second openings of said loop;

inserting a box into said central opening of said loop.

8. The method as claimed in claim 7, wherein said blank material is stretchable.

9. The method as claimed in claim 8, wherein said box is sized slightly larger than said central opening of said loop to stretch said blank material.

10. The method as claimed in claim 8, wherein said box has an outer perimeter that is slightly larger than an inner perimeter of said central opening so that said box stretches said blank material when said box is inserted into said central opening of said loop.

11. The method as claimed in claim 7, wherein said blank material is selected from the group of materials consisting of low density polyethylene, PET, synthetics, natural and combinations thereof.

12. The method as claimed in claim 1, wherein said blank material comprises multiple layers of low density polyethylene or PET that are laminated together.

* * * * *